United States Patent [19]

Saito et al.

[11] Patent Number: 4,462,549

[45] **Date of Patent: * Jul. 31, 1984**

[54] MANUAL TYPE MINIATURE ATOMIZER

[75] Inventors: Tadao Saito; Takao Kishi; Yoshiyuki Kakuta, all of Tokyo, Japan

[73] Assignee: Yoshino Kogyosho Co., Ltd., Tokyo, Japan

[ * ] Notice: The portion of the term of this patent subsequent to Dec. 28, 1999 has been disclaimed.

[21] Appl. No.: 382,097

[22] Filed: May 26, 1982

[30] Foreign Application Priority Data

Jun. 29, 1981 [JP] Japan ..... 56-97523[U]

[51] Int. Cl.[3] ..... B05B 9/00

[52] U.S. Cl. ..... 239/333; 222/321; 222/385

[58] Field of Search ..... 239/333; 222/385, 321

[56] References Cited

U.S. PATENT DOCUMENTS 4,051,983 10/1977 Anderson ..... 222/321
4,365,729 12/1982 Saito et al. ..... 222/321

FOREIGN PATENT DOCUMENTS 2043766 10/1980 United Kingdom ..... 239/333

*Primary Examiner*—John J. Love
*Assistant Examiner*—James Moon
*Attorney, Agent, or Firm*—Parkhurst & Oliff

[57] ABSTRACT

A manual type miniature atomizer having a container for liquid to be atomized, and further having mounting means, a main cylindrical member, a hollow tubular member, a spring, an atomizing head, and an outer cylindrical member. The mouting means is detachably engaged with the neck of the container. The main cylindrical member depends from the flange of the mounting means into the container. The hollow tubular member is elevationally movably engaged at the lower end within the small-diameter portion of the hollow tubular member. The spring urges upwardly the tubular member. When the atomizing head is manually depressed in operation, the interior space in the small-diameter cylinder is reduced and hence the interiors of both the small-diameter and the large-diameter cylinders are simultaneously pressurized. When the tubular member is moved downwardly to the lower limit, the first cylindrical portion of the tubular member is disposed inwardly of the lower seal releasing means formed on the small-diameter cylinder. Thus, the leakage of the liquid in the container can be prevented.

4 Claims, 1 Drawing Figure

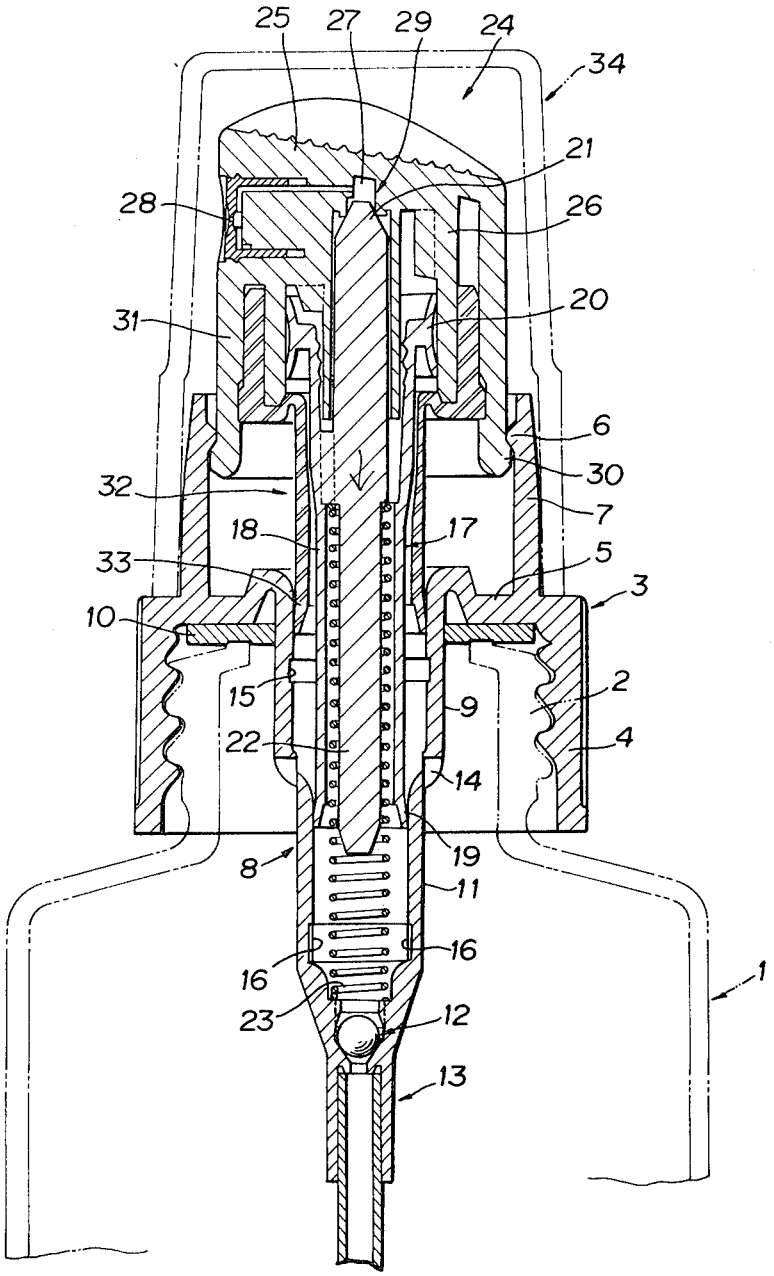
25
27
29
24
34
21
28
26
31
20
6
30
32
7
18
17
33
5
3
10
2
15
9
22
4
14
19
8
11
16
16
1
23
12
13

MANUAL TYPE MINIATURE ATOMIZER

BACKGROUND OF THE INVENTION

The present invention relates to an atomizer, and more particularly to a miniature atomizer of manual type for atomizing a liquid such as perfume or cosmetic preparations with a vertical reciprocating pump.

Various types of miniature atomizers of the manual type have heretofore been proposed.

In the manual type miniature atomizer of the conventional construction, the disadvantage of improper atomization is liable to take place when the depressing operation of the atomizer head is carried out at a relatively low speed. Further, when a cylindrical piston is moved downward within a cylinder, liquid, which has been confined in the cylinder, is permitted to pass through the bore of the stem and then to spurt from the outlet of the nozzle in an atomizer head, and at this instant, the liquid thus discharged will be atomized within the ambient air into a fine mist. When the atomizer head is set free after the depressing operation, the cylindrical piston is returned or moved upwardly together with the head by the action of a built-in coil spring so that a vacuum is again established in the cylinder. This will admit the liquid from its container into the cylinder, causing leakage of the liquid. Further, when pumping action occurs, the atomizer head tends to fluctuate in the reciprocation of the stem in the cylinder.

SUMMARY OF THE INVENTION

It is, therefore, one primary object of the present invention to provide a manual type miniature atomizer which can preferably atomize a liquid under uniform atomizing pressure by eliminating the above described drawbacks and disadvantages.

Another important object of the present invention is to provide an improved manual type miniature atomizer which can eliminate the leakage of the liquid from the atomizing nozzle at the atomizing head upon and after atomization of the liquid.

Still another object of the present invention is to provide an improved manual type miniature atomizer which can obviate the fluctuation of the atomizing head upon pumping action but can atomize the liquid in a stable state.

The foregoing objects and other objects will become more apparent and more readily understandable by the following description and appended claims when read in conjunction with the accompanying drawing.

BRIEF DESCRIPTION OF THE DRAWINGS

The FIGURE is a longitudinal elevational sectional view of the upper portion of a manual type miniature atomizer showing one preferred embodiment according to the present invention.

DESCRIPTION OF THE PREFERRED EMBODIMENTS

A manual type miniature atomizer according to the present invention will now be described with reference to the FIGURE. Reference numeral 1 indicates a liquid container, and a neck portion 2 of the container 1 is detachably threaded with the peripheral wall 4 of mounting means 3. The mounting means 3 has an inwardly extending flange 5 at the upper end of the peripheral wall thereof, and a hollow cylindrical engaging portion 7 is upwardly protruded integrally with the flange 5 at the slightly inward position from the outer periphery on the upper surface of the flange 5. The cylindrical engaging portion 7 is further formed with an upper annularly inwardly projecting strip 6 on the upper inner surface thereof.

A main cylindrical member or portion 8 is formed and arranged to depend from the inner peripheral edge of the flange 5 of the mounting means 3 into the container 1. The mounting means 3 and the main cylindrical member 8 may be, as shown, integrally formed, or may, in case that they are separately formed, be so formed that an outward flange is projected from the upper end of a cylindrical guide portion 9 of the main cylindrical member 8 and the outward flange is interposed between the surface of the top opening of the container 1 and the inward flange of the mounting means 3. In the embodiment exemplified as shown, a packing 10 is interposed between the top surface of the container 1 and the inward flange 5. A small-diameter cylinder 11 having a smaller diameter than the cylindrical guide portion 9 is formed and arranged to depend from the lower end of the cylindrical guide portion 9 of the main cylindrical member 8, and sucking means 13 with a suction valve 12 is formed and arranged to depend from the lower end of the small-diameter cylinder 11. A hole 14 is perforated at the lower end of the cylindrical guide portion 9. An inner annular recess 15 is formed as intimate contact releasing means of the third cylindrical piston, which will be hereinafter described in greater detail on the inner intermediate surface of the cylindrical guide portion 9, and an inner annular recess 16 for releasing the sealing as intimate contact releasing means of the first cylindrical piston, which will be hereinafter described in greater detail, is longitudinally formed on the inner lower end surface of the small-diameter cylinder 11.

A hollow tubular member 17 is elevationally movably engaged at the lower end thereof within the small-diameter cylinder 11. The tubular member 17 has a tubular portion 18. The tubular portion 18 is formed at the lower end thereof with the first cylindrical piston 19 engaged within the small-diameter cylinder 11, and is also formed at the outer upper periphery thereof with the second cylindrical piston 20 having larger diameter than the first cylindrical piston 19. An exhaust valve body 21 is upwardly protruded from the inner surface of the tubular portion 18. The inner surfaces of both the first and the second cylindrical pistons 19 and 20 are communicated with one another. As shown, a rod 22 is formed and arranged to depend from the discharge valve body for reducing the inner space of the tubular portion.

A coil spring 23 is mounted in the small-diameter cylinder 11 for urging upwardly the tubular member 17.

In an atomizing head 24, a large-diameter cylinder 26 is formed and arranged to depend from the lower surface of a head portion 25, has a larger diameter than the small-diameter cylinder 11, and an exhaust valve hole 27 is perforated at the center on the lower surface of the head portion 25, and a nozzle hole 28 is perforated at the outer surface of the head portion 25 to communicate with the exhaust valve hole 27. The second cylindrical piston 20 is elevationally movably engaged within the large-diameter cylinder 26, the exhaust valve hole 27 is closed by the upper end of the exhaust valve body, and the exhaust valve body and the exhaust valve hole thus form an exhaust valve 29. The second engaging cylinder 31 is formed and arranged to depend from the outer lower periphery of the head portion 25 and has the second outer annularly engaging strip 30 formed on the outer lower peripheral end thereof. When the second engaging cylinder 31 is elevationally movably engaged with the inner surface of the cylindrical engaging portion 7 to engage the engaging strip 6 with the second engaging strip 30, the atomizing head is prevented from being removed.

An outer cylindrical portion 32 is engaged at the upper end thereof with the outer surface of the large-diameter cylinder 26. The outer cylindrical portion 32 may be preferably formed with large diameter at the upper cylindrical portion as shown. The hollow tubular member 17 is passed through the outer cylindrical portion 32, the third cylindrical piston 33 is attached to the lower end of the outer cylindrical guide portion 9. The interior of the large-diameter cylinder 26 is communicated with the guide portion 9 through the flow passage formed between the tubular member 17 and the outer cylindrical portion 32. The cylindrical piston 33 is disposed, when the atomizing head 24 is located at the upper limit, at the upper inner surface of the guide portion 9, and is disposed, when the atomizing head 24 is located at the lower limit, above the hole 14 at the lower end of the guide portion 9. Reference numeral 34 illustrates a cap.

With the atomizer of these construction arrangements, when the atomizing head 24 is manually depressed in operation in the state that liquid is not yet filled in both the cylinders of the atomizer, the suction valve 12 and the exhaust valve 29 are simultaneously closed. As the atomizing head 24 is depressed downwardly, the interior space in the small-diameter cylinder 11 is reduced, and hence the interiors of both the small-diameter and the large-diameter cylinders are simultaneously pressurized due to the communication of the tubular member 17. Thus, the tubular member 17 is downwardly moved with respect to the atomizing head 24 due to the difference of the diameters of both the small-diameter and the large-diameter cylinders, and accordingly the exhaust valve 29 is opened, and the high pressure air in both the small-diameter and the large-diameter cylinders is injected from the nozzle hole 28.

When the tubular member 17 is moved downwardly to the lower limit, the first cylindrical portion 19 is disposed inwardly of the lower seal releasing means. Thus, the intimately contacting state of the small-diameter cylindrical piston 19 is released from the inner surface of the small-diameter cylinder 11 at the recess 16, and accordingly the highly pressurized air in the cylinder is exhausted between the outer surface of the tubular portion 18 and the inner surface of the small-diameter cylinder 11 from the hole 14 into the container 1. Inasmuch as the third cylindrical piston 33 is disposed below the above intimate contact releasing means at this time and is thus intimately contacted with the inner surface of the guide portion 9, the high pressure air exhausted from the cylinder is not exhausted from the upper end of the guide portion 9. As the high pressure state in both the cylinders is thus released, the exhaust valve 29 is closed. When the atomizing head 24 is released from the manual depression, the tubular member 17 is pushed upwardly by the spring 23, the interior of the small-diameter cylinder 11 is then expanded, is hence reduced under pressure, the suction valve 12 is thus opened, and the liquid in the container is thus sucked into the cylinder.

The cylinder is thus filled with the liquid from the container upon next manual depression of the atomizing head and is atomized. The interior of the container is reduced under pressure due to the reduction of the liquid in the container, but when the third cylindrical piston 33 is disposed inwardly of the intimate contact releasing means located above, the negative pressure is prevented, since the intimate contact of the piston is released, by the introduction of atmospheric air through the releasing means and the hole 14 into the container 1.

As has been described hereinbefore, the manual type miniature atomizer according to the present invention can accordingly substantially equalize the atomizing pressure, and hence equalize substantially the atomizing particles. Further, since the outer cylindrical portion 32 is provided and the upper end of the cylindrical portion 32 are intimately engaged with the outer surface of the large-diameter cylinder 2 and the third cylindrical portion 33 attached to the outer lower periphery of the cylindrical portion 32 is engaged within the guide portion, the liquid from the container is, even if the liquid is leaked from the large-diameter cylinder, introduced into the guide portion and is hence circulated through the inside of the intimate contact releasing means provided on the inner intermediate surface of the guide portion by the third cylindrical piston and the hole 14 into the container 1, thereby eliminating the leakage of the liquid. Furthermore, since the stem part between the main cylindrical portion and the atomizing head is formed with the double cylinders of the tubular member and the outer cylindrical portion, the atomizing head is not fluctuated upon manual depression of the atomizing head, but can be always stably depressed.

What is claimed is:

1. A manual type miniature atomizer comprising:

a container having a neck portion, mounting means detachably engaged with the neck portion of said container, a main cylindrical member having a cylindrical guide portion depending from said mounting means into said container, a small-diameter cylinder depending from the lower end of the guide portion into said container and having smaller diameter than the guide portion and sucking means with a suction valve depending from the lower end of the cylinder into said container, a hollow tubular member having first cylindrical piston attached to the outer lower periphery of a tubular portion and engaged within the small-diameter cylinder of said main cylindrical member elevationally movably, second cylindrical piston attached to the outer upper peripheral end of the tubular portion and having larger diameter than the first piston, and an exhaust valve upwardly protruded from the inner surface of the tubular portion in such a manner that the inner surfaces of both the pistons are communicated with one another, a spring mounted within the small-diameter cylinder of said main cylindrical member for urging upwardly said tubular member, an atomizing head having a large-diameter cylinder elevationally movably engaged with the second piston of said hollow tubular member and depending from the lower surface of a head portion, and exhaust valve hole closed by the pressure contact of the upper end of the exhaust valve body of said tubular member and perforated at the center on the lower surface of the head portion, and a nozzle hole communicated with the valve hole and perforated at the outer surface of the head portion, and an outer cylindrical member having an upper end airtightly engaged with the outer surface of the large-diameter cylinder, third cylindrical piston attached to the outer lower peripheral end thereof and elevationally movably engaged with the guide portion of said main cylindrical member, and a liquid flow passage formed between said tubular member and said outer cylindrical member for communicating the large-diameter cylinder of said atomizing head with the guide portion of said main cylindrical member, said guide portion having a hole at the lower end thereof and intimate contact releasing means formed on the inner surface of the guide portion disposed at the intermediary of the stroke of the third cylindrical piston of said outer cylindrical member.

2. A manual type miniature atomizer as claimed in claim 1, wherein the cylindrical guide portion of said main cylindrical member has an inner annular recess formed on the inner intermediate surface thereof.

3. A manual type miniature atomizer as claimed in claim 1, wherein the small-diameter cylinder of said main cylindrical member has an inner annular recess for releasing the sealing between the first cylindrical piston and the small-diameter cylinder.

4. A manual type miniature atomizer comprising:

a container having a neck portion, mounting means detachably engaged with the neck portion of said container, a main cylindrical member having a cylindrical guide portion depending from said mounting means into said container, a small-diameter cylinder depending from the lower end of the guide portion into said container and having smaller diameter than the guide portion and sucking means with a suction valve depending from the lower end of the cylinder into said container, a hollow tubular member having first cylindrical piston attached to the outer lower periphery of a tubular portion and engaged within the small-diameter cylinder of said main cylindrical member elevationally movably, second cylindrical piston attached to the outer upper peripheral end of the tubular portion and having larger diameter than the first piston, and an exhaust valve upwardly protruded from the inner surface of the tubular portion in such a manner that the inner surfaces of both the pistons are communicated with one another, said exhaust valve being integrally formed with said hollow tubular member, a spring mounted within the small-diameter cylinder of said main cylindrical member for urging upwardly said tubular member, an atomizing head having a large-diameter cylinder elevationally movably engaged with the second piston of said hollow tubular member and depending from the lower surface of a head portion, and exhaust valve hole closed by the pressure contact of the upper end of the exhaust valve body of said tubular member and perforated at the center on the lower surface of the head portion, and a nozzle hole communicated with the valve hole and perforated at the outer surface of the head portion, and an outer cylindrical member having an upper end airtightly engaged with the outer surface of the large-diameter cylinder, third cylindrical piston attached to the outer lower peripheral end thereof and elevationally movably engaged with the guide portion of said main cylindrical member, and a liquid flow passage formed between said tubular member and said outer cylindrical member for communicating the large-diameter cylinder of said atomizing head with the guide portion of said main cylindrical member, said guide portion having a hole at the lower end thereof and intimate contact releasing means formed on the inner surface of the guide portion disposed at the intermediary of the stroke of the third cylindrical piston of said outer cylindrical member.

* * * * *